US007313871B2

(12) United States Patent
Lines et al.

(10) Patent No.: US 7,313,871 B2
(45) Date of Patent: Jan. 1, 2008

(54) ARCHERY SIGHT

(76) Inventors: Joseph R. Lines, 7713 E. San Jose Rd., Safford, AZ (US) 85546; John T Lines, 480 N. Buena Vista Rd., Safford, AZ (US) 85546

( * ) Notice: Subject to any disclaimer, the term of this patent is extended or adjusted under 35 U.S.C. 154(b) by 25 days.

(21) Appl. No.: 11/084,952

(22) Filed: Mar. 21, 2005

(65) Prior Publication Data

US 2006/0156560 A1 Jul. 20, 2006

Related U.S. Application Data

(60) Provisional application No. 60/644,957, filed on Jan. 18, 2005.

(51) Int. Cl.
*F41G 1/00* (2006.01)
*F41G 1/46* (2006.01)

(52) U.S. Cl. ..... 33/365; 33/286; 33/DIG. 21; 124/87

(58) Field of Classification Search ..... 33/265, 33/286, DIG. 21; 124/87; 42/111, 113, 42/114, 115, 117, 141, 142, 146
See application file for complete search history.

(56) References Cited

U.S. PATENT DOCUMENTS 4,325,190 A * 4/1982 Duerst ..... 33/265
4,711,036 A * 12/1987 Morris ..... 33/265
4,753,528 A 6/1988 Hines et al.
4,836,671 A * 6/1989 Bautista ..... 356/3.1
4,894,921 A * 1/1990 Barlow ..... 33/265
5,090,805 A * 2/1992 Stawarz ..... 356/251
5,152,068 A * 10/1992 Meister et al. ..... 33/265
5,493,786 A * 2/1996 Thomson ..... 33/1 G
5,495,675 A 3/1996 Huang
5,584,137 A 12/1996 Teetzel
5,584,569 A * 12/1996 Huang ..... 362/288
5,634,278 A * 6/1997 London ..... 42/132
5,782,002 A 7/1998 Reed
5,784,792 A * 7/1998 Smith ..... 33/227
5,810,674 A * 9/1998 Falossi et al. ..... 473/220
6,073,352 A * 6/2000 Zykan et al. ..... 33/365
6,094,829 A * 8/2000 Koestler, III ..... 33/265
6,134,793 A * 10/2000 Sauers ..... 33/265
6,199,286 B1 * 3/2001 Reed et al. ..... 33/265
6,230,431 B1 * 5/2001 Bear ..... 42/117
6,366,344 B1 4/2002 Lach
6,397,483 B1 * 6/2002 Perkins ..... 33/265
6,453,568 B1 * 9/2002 Hymer ..... 33/276
6,494,604 B2 * 12/2002 Khoshnood ..... 362/577
6,693,702 B2 * 2/2004 Rogers ..... 356/3.1
6,796,038 B2 * 9/2004 Humphries ..... 33/265
6,877,236 B1 * 4/2005 Williams ..... 33/286
6,891,148 B1 * 5/2005 Rivera et al. ..... 250/221
2005/0278964 A1 * 12/2005 Minica et al. ..... 33/265

* cited by examiner

OTHER PUBLICATIONS

The New Albany Shooting Range, pages from their website found through website archive, dated Mar. 31, 2001.*

*Primary Examiner*—G. Bradley Bennett
*Assistant Examiner*—Amy R. Cohen
(74) *Attorney, Agent, or Firm*—Etherton Law Group, LLC

(57) ABSTRACT

An improved laser sight apparatus that is capable of identifying and impinging several different targets at varying ranges from the shooter. In the preferred embodiment, the laser sight according to the present invention includes three lasers, each of which is pre-calibrated to impinge targets within a range that is distinct from the other two lasers. In an alternative embodiment, the laser sight can utilize a single laser that is capable of an automated adjustment to identify and impinge targets at various ranges.

19 Claims, 4 Drawing Sheets

ARCHERY SIGHT

CROSS-REFERENCE TO RELATED APPLICATIONS

This application claims the benefit of co-pending provisional application No. 60/644957 filed on Jan. 18, 2005.

FIELD OF INVENTION

The present invention relates generally to a sighting device for increasing the ease and accuracy of bow sightings. More particularly, the present invention relates to a laser targeting device which attaches to a bow.

BACKGROUND

The sport of archery is growing in popularity. Due to the physics involved with projectile motion and the challenges presented by the environment, accuracy is dependant upon the equipment utilized as well as the skill of the archer. One of the biggest challenges that archers face is the natural loss of altitude an arrow experiences as it flies through the air towards its target. An archer must actually aim the bow above the intended target to account for this drop in altitude. If an archer is within a relatively close range to the target, he must only aim slightly above the intended target to account for this altitude loss. The farther the archer is from the target, the more he will have to aim above the target to account for the larger loss of altitude that results from the longer distance the arrow must travel before reaching its intended target. Compensating for the loss of an arrow's altitude is one of the greatest obstacles of archery. To address this challenge, various devices have been developed that are referred to as "peep sights."

Traditional peep sights are commonly comprised of two parts whereby one part comprises a pin plate, a pin guard, and a plurality of sight pins which are secured to the pin plate and extend into a sight window formed by the pin guard. The second part comprises a circular member mounted directly on the string that aids the user in focusing on the sight pins when it is brought directly in front of the user's eye during use. When the bow string is drawn, the archer can look through the circular member and align the tip of one of the sight pins with a target. For sights utilizing a plurality of sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at a 70 yard distance.

A review of the current bow sights indicates several problems with them. Obviously, the eye of the user cannot focus clearly on both the target, which is usually at a substantial distance, and the elements of the sight which are within about an arm's length of the eye of the user. Thus, substantial personal skill and art have been required for the effective use of peep sights. Such skill may take years to acquire. Archers using such sights typically close one eye, leading to eye strain and causing targeting problems due to common eye dominance problems. Additionally, once these sights have been adjusted for one archer, they must be readjusted for each archer who wishes to accurately use the same bow.

These peep sights are also a safety hazard, as they cause the archer to position the bow string next to his nose so that he is able to look through the sight. The bow string, when released, may strike the archer's nose or arm, or snag his glasses. An additional problem with string-mounted sights is their tendency to slip along the string from time to time, thus altering the elevational accuracy of the sight. Additionally, string-mounted sights create drag as the string moves through the air; this drag causes decreased arrow speeds and thus decreased firing distances.

Further, a number of the known sights are not adaptable for left-handed shooters. This eliminates the usefulness of the sight for a large population of archers. Furthermore, peep sights are very fragile and easily breakable in an outdoor setting. Additionally, these devices typically require lubrication which is often not performed, leading to maintenance problems. Further, the lubricant often attracts dirt and debris into the open mechanism, thereby accelerating wear and leading to inaccuracy. Finally, peep sights are of limited use when the archer is standing in a low light environment, as he must be able to see the pins in order to target the bow.

To address the problems with traditional peep sights, laser sights have been developed which can be attached to a bow. Laser sights are typically attached to the bow and emit a laser light that impinges the intended target. The lasers are set at an angle relative to the ground to compensate for the arrow's drop in altitude. Because lasers produce a beam of light that is completely straight, a single laser beam will not be able to correctly identify targets at various ranges due to the aforementioned problems with an arrow's altitude loss during flight. That is, a laser beam set at the proper angle for an arrow to hit a target at thirty yards would necessarily be set at a different angle for the arrow to hit a target at sixty yards. To account for altitude loss, known laser sights utilize a variety of adjustable mechanical mechanisms to either point the laser in an upward or downward direction. These mechanisms typically include adjustable screws and cams which must be adjusted by hand and then recalibrated each and every time an archer encounters a target at a different range.

This manual calibration often is time consuming and cannot be adjusted in the field because it would cause the archer to miss his intended target due to time spent adjusting the laser sight. Therefore, a need exists for a laser sight apparatus that would be capable of accurately identifying targets in the field at several different ranges without the need for manual calibration.

Therefore, one of the many objects of the present invention is to provide a laser sight that can be attached to a bow or other type of weapon which is capable of impinging a plurality of targets in different ranges without recalibrating the sight.

SUMMARY OF THE INVENTION

The present invention provides a laser sight apparatus that can be attached to a weapon, such as a compound bow. The sight includes a laser device that can correctly impinge a plurality of targets in different ranges without being recalibrated by the user. In one preferred embodiment, the laser sight includes a housing which includes three lasers that are powered by a battery. Each of the three lasers emits light to impinge a target within a certain predetermined range that is distinct from the range impinged by the other two lasers. For example, one laser might be calibrated to emit light to accurately aim at targets within 30 yards of the shooter while a second laser might be capable of emitting light to accurately aim at targets at a range of up to 60 yards. The third laser may be calibrated to accurately aim at targets at a range of over 100 yards in this preferred embodiment.

The device is powered by a battery and controlled by electronic circuitry. To ease the use of the device, the sight may be equipped with an indicator which enables the user to easily identify which laser, and therefore which targeted distance is "on". In the preferred embodiment, this indicator is a set of light emitting diodes ("LEDs"). Each LED is capable of illuminating when its corresponding laser is in use. Another switch enables the user to switch from one laser to the other. To further increase the ease of use, the laser sight may also be equipped with an "on/off" switch and a switch to place the device in a "sleep" mode to conserve energy. It should also be understood that while this specification references the use of the present invention with a bow and arrow, any device used to project objects towards targets could be used with the laser sight described herein and still fall within the scope of the present invention. Examples of such devices include, but are not limited to, guns, rifles, and sling shots.

DETAILED DESCRIPTION OF THE INVENTION

Figure 1:
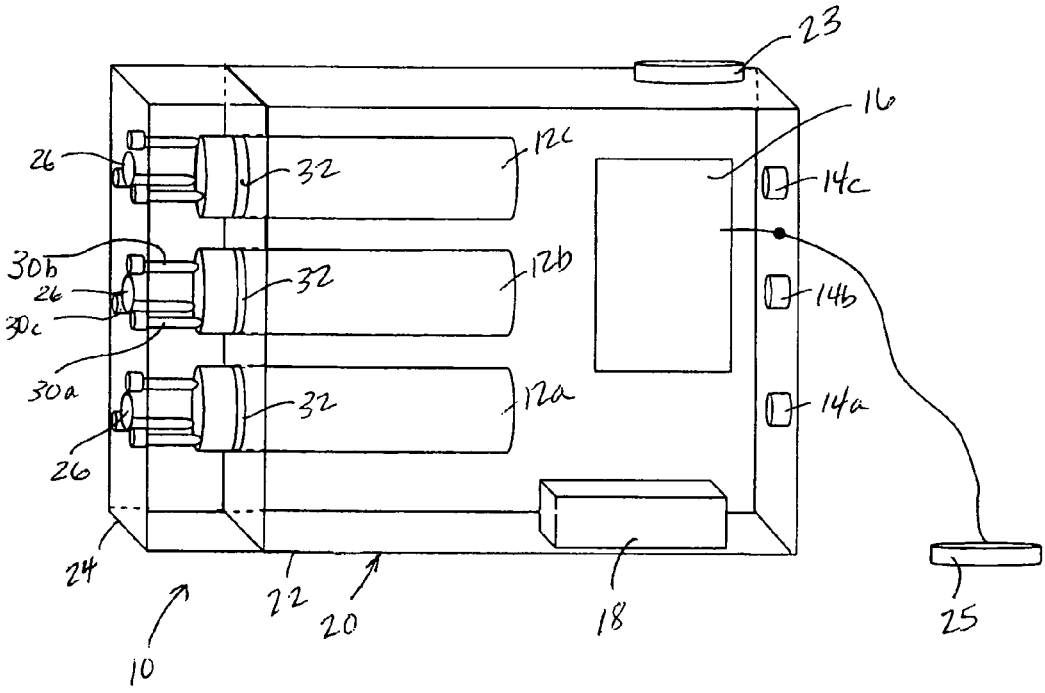
FIG. 1 illustrates a cutaway view of the laser sight device in accordance with one embodiment of the present invention.
Figure 2:
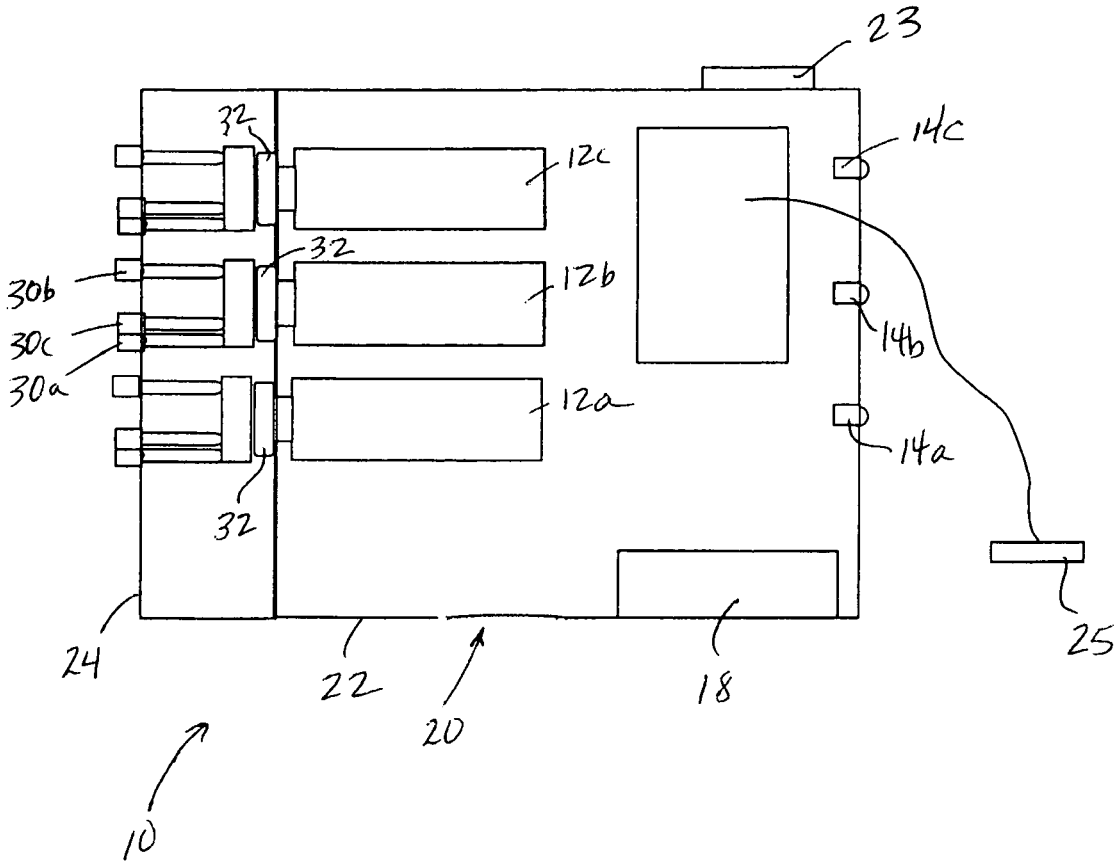
FIG. 2 illustrates a side view of the laser sight device in accordance with one embodiment of the present invention.

In accordance with one embodiment of the present invention, laser sight 10 includes at least one laser 12 that is switchable during use from a first calibrated distance to a second calibrated distance, an electronic circuit 16 providing the user with control of laser sight 10, and a power source 18. Laser sight 10 may also include at least one indicator capable of indicating whether one or more of the lasers 12 are "on" or "off". When the laser sight 10 has been properly calibrated for a predetermined range, a light beam (not shown) converges with the line of fire and the user's line of vision at the target (not shown) thereby enabling the user to correctly identify and impinge the target.

In the preferred embodiment, laser sight 10 is equipped with one or more lasers 12 that are preferably semiconductor diode lasers. Lasers 12 are powered by a power source 18, preferably a battery. These components are housed within a body 20. Laser sight 10 is equipped with a first "on/off" switch 23 that enables power to be delivered from power source 18 to lasers 12 as well as a second switch 25 to adjust which one of the lasers is emitting light. Switch 25 is preferably a pressure-momentary switch and can also be used to place lasers 12 in a "sleep" mode by known methods to conserve energy. In the preferred embodiment, on/off switch 23 is located on body 20 and second switch 25 is attached directly to the bow itself and connected to body 20 by an electrical wire.

The lasers are calibrated for the desired distances before going into the field. In the preferred embodiment, the lasers 12 and the body 20, comprising a primary housing 22 and a secondary housing 24 which is a face plate, cooperate with an interposed o-ring to set the lasers for the desired distances, as is known in the art. Lasers 12 are located mainly in primary housing 22 and pass through apertures defined by primary housing 22 and a set of corresponding apertures defined by secondary housing 24. The laser light passes through aperture 26 in the face of the secondary housing 24. An O-ring 32 or other similar device is disposed between laser 12 and secondary housing 24 to aid in the adjustment of lasers 12. Lasers 12 are positioned using one or more screws 30 by known methods. Specifically, at least two screws 30 are used to calibrate each laser 12. As one screw 30 is screwed inward, more pressure is applied to a specific area of O-ring 32 and laser 12 is moved slightly. For example, if the user needed to move laser 12 to the right, he would adjust screw 30*b* to force laser 12 to the right. Alternatively, laser 12 could be moved to the left by adjusting screw 30*c*. One screw 30*a* can serve to anchor laser 12 to secondary housing 24 and does not need to be used for calibration purposes.

Lasers 12 are preferably low-level lasers and there are numerous laser energy sources known in the art that can be used. They include Helium-Neon lasers having a 632 nm wavelength and semiconductor diode lasers with a broad range of wavelengths between 600-800 nm. The laser energy sources in the preferred embodiment are three semiconductor laser diodes that produce light in the red range of the visible spectrum, having wavelengths of about 635 nm. Other suitable wavelengths are used for other particular applications. For example, green, blue, and yellow lasers may be utilized for aiming at different distances or in different ambient lighting conditions Solid state and tunable semiconductor laser diodes may also be employed to achieve the desired wavelength.

In the preferred embodiment, each of three lasers 12 emits light to impinge a target within a certain predetermined range. For example, laser 12*a* located within the bottom portion of body 20, could be pre-calibrated to emit light to impinge a target within approximately 30 yards of the user. Laser 12*b*, located directly above laser 12*a*, could be pre-calibrated to impinge a target within a range of approximately 60 yards of the user. Finally, laser 12*c* could be pre-calibrated to impinge a target within approximately 120 yards of the user. Therefore, laser sight 10 can be used to correctly impinge several targets at different ranges without the need for manually adjusting the device to account for targets located at different ranges. If any of the lasers 12 were to become miscalibrated, the user could adjust the miscalibrated laser 12 by adjusting the appropriate screw 30 on secondary housing 24 as noted above.

Because the emitted laser light from one laser may appear to be identical to that of one of the other lasers, it may be difficult during use to determine which laser is "on." Consequently, an indicator is provided to enable the user to quickly identify which laser is on, and, therefore, at which distance the sight is aiming. In the preferred embodiment, a set of LEDs 14 indicates to the user which laser 12 is emitting light and, therefore, which range the user can accurately attain given the specific laser 12 being used. There are three LEDs, 14*a*, 14*b*, and 14*c* to correspond to lasers 12*a*, 12*b*, and 12*c*. For example, LED 14*a* would illuminate upon the emission of light from laser 12*a*. Alternatively, lasers 12 and LEDs 14 may correspond by means of color, so that the activation of a specific laser 12 co-activates an LED 14 of a specific color. In this way, the user may glance at LEDs 14 and immediately know which one of lasers 12 is emitting light.

Figure 3:
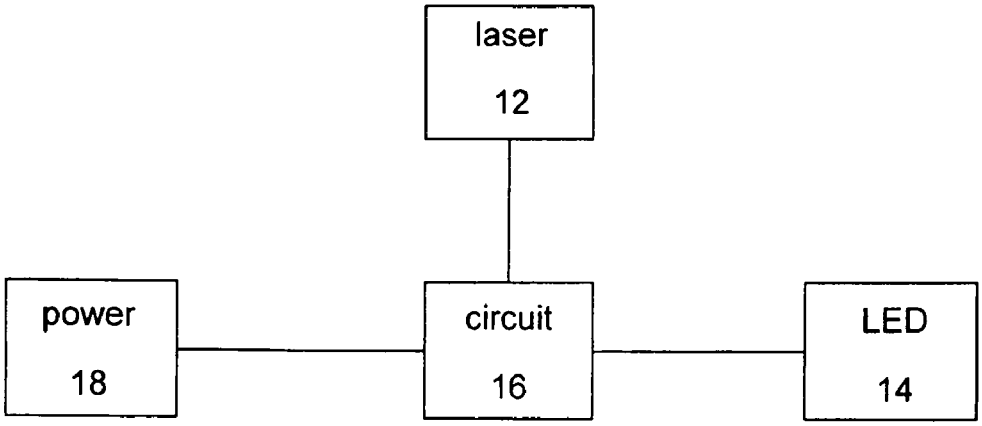
FIG. 3 is a schematic illustration of the device.
Figure 4:
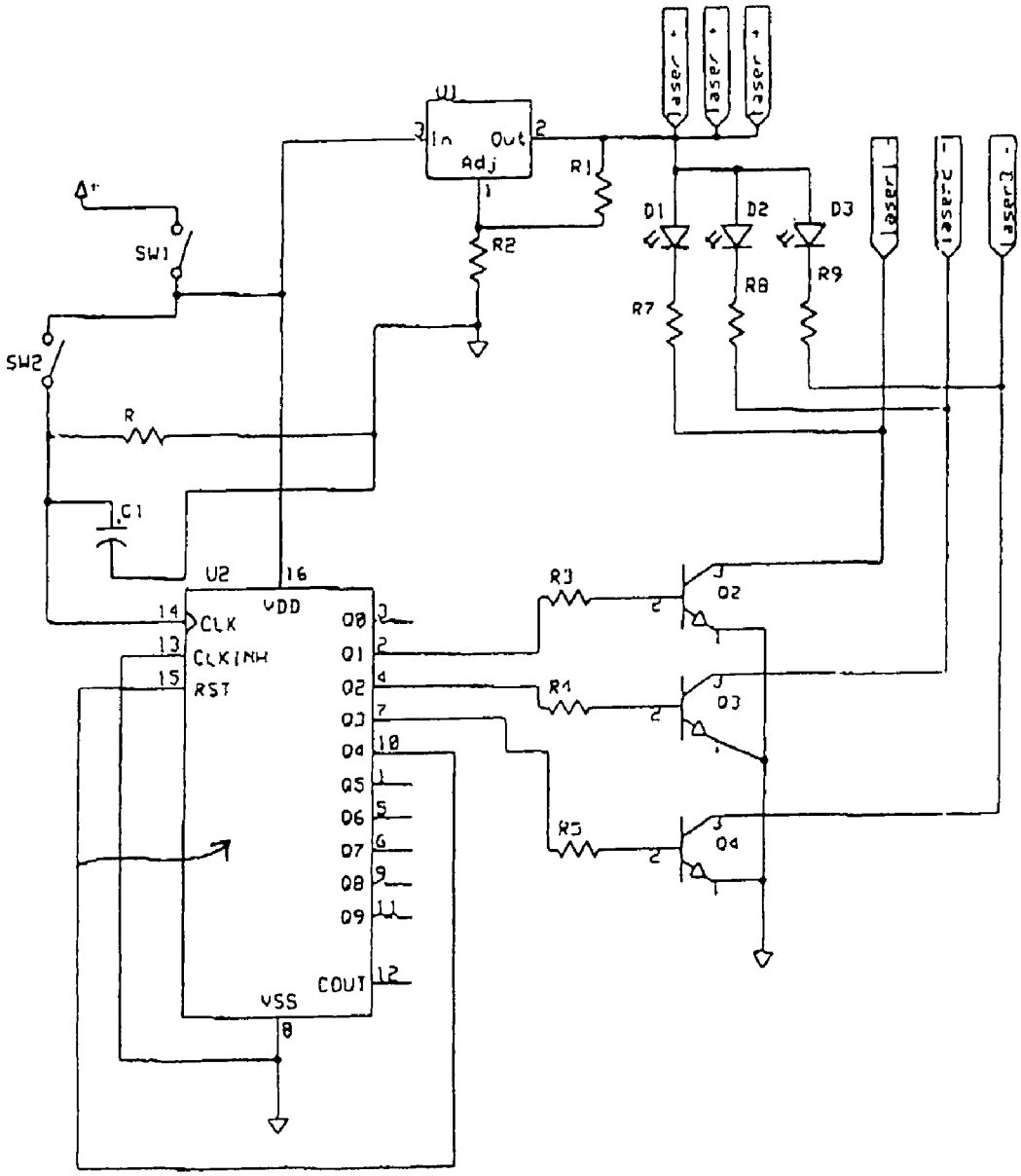
FIG. 4 illustrates one electrical circuit of the laser sight device.

Electric circuitry 16 controls the power delivery from power source 18 to lasers 12 and LEDs 14 as well as the corresponding illumination of LEDs 14 to lasers 12. Electric circuitry 16 may be any known type of electrical circuit to control the operation of laser sight 10 including discrete components or an integrated circuit. A specific embodiment of electric circuit 16 is shown in FIG. 3. In the preferred embodiment, electric circuitry 16 includes at least an "on/off" switch and a trigger switch to switch the power delivery from one of the lasers 12 to another of the lasers 12 (i.e. from laser 12*a* to laser 12*b* for example). Electric circuitry 16 also controls the correlation between lasers 12 and LEDs 14 as well as enabling laser sight 10 to be placed in the "sleep" mode.

In use, laser sight 10 could be used in the following manner. A user would first attach laser sight 10 to a weapon such as a compound bow before going hunting or target shooting. Then, the user would calibrate the laser sight to the desired distances, for example, 30, 60 and 90 yards. This would enable the user on a hunting or target shooting expedition to be able to aim at targets at various ranges using laser sight 10 without the need for any manual calibration of laser sight 10 in the field. For example, if the user saw a target at a distance of 30 yards he would activate laser 12*a* as this specific laser would be pre-calibrated to correctly impinge targets within a 30 yard range. The user could identify his target by placing the beam produced by laser 12*a* on the target and then hit the target with the arrow. Then, if the user saw another target at a distance of 60 yards, he would press second switch 25 to activate the laser 12*b* having a 60 yard capability and repeat the exact procedure used to hit the first target, only he would utilize laser 12*b* instead of laser 12*a*. In order to turn off laser 12*a* and turn on laser 12*b*, the user would depress second switch 25.

In various alternative embodiments, any number of lasers could be used and fall within the scope of the present invention. For example, an automatically adjustable single laser could be used. In this embodiment, the laser would be pointed upwards or downwards by various automated means to accommodate targets at different distances. Mechanisms to adjust the laser could include a mechanically or electrically driven screw member (not shown) attached to the laser, an automated cam member that could move the laser either upwards or downwards, or a set of detents associated with a laser wherein the laser would aim at a different distance when set in each detent. In this alternative embodiment, it is anticipated that the laser would be switchable from at least two pre-set positions wherein one position caused laser light to impinge a target within a specific range and the other position caused light emitted from the laser to impinge a target at another range that is distinct from the first range. Alternative indicators may be used as well, such as a mechanical flag that becomes visible when its corresponding laser is on, or a digital read-out which indicates which laser is on.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A sight apparatus comprising:

a) a first laser calibrated to impinge a first target at a first distance and a second laser calibrated to impinge a second target at a second distance, wherein the first and second lasers are not on at the same time; wherein b) the sight apparatus is switchable during use from the first distance to the second distance.

2. The sight apparatus according to claim 1 wherein the sight apparatus is removably attached to a weapon.

3. The sight apparatus according to claim 2 wherein the weapon is an archery bow.

4. The sight apparatus according to claim 2 wherein the weapon is a gun.

5. The sight apparatus according to claim 1 wherein the first and second lasers are semiconductor laser diodes.

6. The sight apparatus according to claim 1 further comprising circuitry and a power source wherein the circuitry delivers and switches power from the first laser to the second laser.

7. The sight apparatus according to claim 1 further comprising an indicator to indicate to the user which laser is on.

8. An archery bow in combination with a sight apparatus whereby the sight apparatus comprises:

a) a housing;

b) a first laser disposed within the housing that is calibrated to emit light to impinge a target within a range of about 0 to 30 yards;

c) a second laser disposed within the housing that is calibrated to emit light to impinge a target within a range of about 0 to 60 yards; and d) a third laser disposed within the housing that is calibrated to emit light to impinge a target within a range of about 0 to 120 yards.

9. The archery bow in combination with a sight apparatus according to claim 8 wherein at least two of the first, second, and third lasers emit light of different colors.

10. The archery bow in combination with a sight apparatus according to claim 8 further comprising circuitry and a power source, wherein the circuitry delivers and switches power from the first laser to the second or third laser.

11. The archery bow in combination with a sight apparatus according to claim 8 further comprising a switch to place the sight apparatus in a "sleep" mode.

12. The archery bow in combination with a sight apparatus according to claim 8 further comprising a switch to cause each of the first, second or third lasers to emit tight.

13. A method of impinging a plurality of targets at different ranges comprising the steps of:

a) providing a sight apparatus capable of being attached to a weapon, the sight apparatus comprising:

i. a first laser calibrated to emit light to impinge a first target within a first range, and ii. a second laser calibrated to emit light to impinge a second target within a second range that is greater than the first range:

b) identifying the first target;

c) identifying the second target; and d) impinging any one of the first or second targets.

14. The method according to claim 13 wherein the weapon is a compound archery bow.

15. The method according to claim 13 wherein the weapon is a gun.

16. The method according to claim 13 further comprising providing the sight apparatus with a third laser calibrated to emit light to impinge a third target within a third range that is greater than the first or second ranges; and identifying and impinging the third target.

17. The method according to claim 13 further comprising an indicator to indicate to the user which of the lasers is on.

18. A sight apparatus capable of being attached to a bow comprising:

a) a body comprising a primary rectangular housing defining apertures and a secondary rectangular housing attached to the primary housing that defines a set of apertures which are aligned with the apertures located on the primary housing;

b) a power source disposed within the primary housing;

c) three lasers generally disposed within the primary housing, each laser calibrated to impinge a different target at a different distance, whereby each of the three lasers extends through the primary housing and projects light outside of the body through the apertures on the secondary housing;

d) three corresponding light emitting diodes located on the primary housing, wherein each of the light emitting diodes illuminates when its corresponding laser is emitting light; and e) circuitry disposed within the primary housing that controls the power delivered from the power source to the set of three lasers and three light emitting diodes.

19. The sight apparatus according to claim 18 wherein the three lasers are calibrated with screw members to identify targets at various distances.

* * * * *